United States Patent [19]

Suzuki et al.

[11] Patent Number: 5,055,370

[45] Date of Patent: Oct. 8, 1991

[54] IMAGE FORMING RESIN PARTICLES FOR LIQUID DEVELOPER FOR PRINTING PLATE

[75] Inventors: Nobuo Suzuki; Yutaka Sakasai, both of Kanagawa, Japan

[73] Assignee: Fuji Photo Film Co., Ltd., Kanagawa, Japan

[21] Appl. No.: 406,019

[22] Filed: Sep. 12, 1989

[30] Foreign Application Priority Data

Sep. 12, 1988 [JP] Japan ..... 227832/88
Sep. 13, 1988 [JP] Japan ..... 229162/88

[51] Int. Cl.[5] ..... G03G 9/12

[52] U.S. Cl. ..... 430/114; 430/115; 430/49

[58] Field of Search ..... 430/114, 116, 137, 115, 430/49

[56] References Cited

U.S. PATENT DOCUMENTS

| | | | |
|---|---|---|---|
| 4,147,812 | 4/1979 | De Volder et al. | 430/114 |
| 4,157,973 | 6/1979 | Montillier | 252/62.1 |
| 4,181,620 | 1/1980 | Tsubuko | 430/114 |
| 4,631,243 | 12/1986 | Podszun et al. | 430/114 |
| 4,663,265 | 5/1987 | Uytterhoeven et al. | 430/114 |
| 4,719,164 | 1/1988 | Podszun et al. | 430/114 |
| 4,764,447 | 8/1988 | Tsubuko et al. | 430/115 |
| 4,818,657 | 4/1989 | Kondo et al. | 430/114 |
| 4,869,991 | 9/1989 | deGraft-Johnson et al. | 430/115 |

*Primary Examiner*—John Goodrow
*Attorney, Agent, or Firm*—Sughrue, Mion, Zinn, Macpeak & Seas

[57] ABSTRACT

A positively chargeable liquid developer to be used in making a printing plate by developing an electrostatic image formed on the surface of a printing plate precursor with a liquid developer and then by decoating the non-image area, the plate comprising a conductive base plate having provided thereon an electrophotographic photoreceptive layer, the liquid developer containing image forming particles comprising a resin which is prepared by copolymerizing monomers of formulae (I), (II) and (III) in a copolymerizing ratio of 0.1-9.9 : 90-99.8 : 0.1-10 by weight percent, the resin having a number average molecular weight ranging from $5\times10^3$ to $5\times10^5$ and a softening point ranging from 40° C. to 150° C.:

(I)

(II)

(III)

(wherein $R_1$, $R_1'$ and $R_1''$ each represents a hydrogen atom or a methyl group; $R_2$ represents an straight-chain or branched alkyl group containing 4 to 22 carbon atoms; $R_3$ represents a hydrogen atom or a straight-chain or branched alkyl group containing 1 to 4 carbon atoms; $R_4$ represents

;

Z and B each represents $-(CH_2)_n-$ (n=1-4), but B may be absent from the group represented by $R_4$; $X^-$ represents an anion; $R_5$, $R_6$ and $R_7$ may be the same or different, each being a straight-chain or branched alkyl group containing 1 to 12 carbon atoms, or a hydrogen atom, and $R_8$ has the same definition as $R_3$).

16 Claims, No Drawings

IMAGE FORMING RESIN PARTICLES FOR LIQUID DEVELOPER FOR PRINTING PLATE

FIELD OF THE INVENTION

This invention relates to a liquid developer used in making a printing plate by developing a printing plate precursor provided with an electrophotographic photoreceptive layer in accordance with electrophotography, and then by decoating the nonimage area with an etching solution. In particular, it is concerned with a liquid developer which can impart an excellent function as a resist upon etching to the image area.

BACKGROUND OF THE INVENTION

Nowadays, presensitized plates which utilize positively working sensitizers containing diazo compounds and phenol resins as main components, and negatively working sensitizers containing acryl series monomers or prepolymers as main component are put to practical use as lithographic offset printing plates. However, such plates all have low sensitivity, so images are reproduced in these plates through contact exposure using, as printing master, silver salt photographic films in which the images have been recorded in advance. Through advances in computer aided image processing, mass data storage and data communication techniques, on the other hand, electronic editing systems, wherein input, correction, editing, layout and page allotment of originals are consecutively performed by operating a computer and the resulting copies are taken out in real time as the output of terminal plotters installed in remote places by utilizing a high speed communication network or satellite communication, have been put to practical use in recent years. In particular, the field of news printing, in which rapidness is required, has the most crying need of the electronic editing system. In addition, in the field of keeping originals in the form of master films and reproducing printing plates therefrom as occasion arises, it is expected that originals will be stored in recording media in the form of digital data with the development of recording media having very large capacity, such as optical discs.

However, scarcely any direct reproduction system for making printing plates directly from the output of a terminal plotter has been put to practical use as yet. In the present situation, though an electronic editing system is at work, yet the output is recorded in a silver salt photographic film, and the resulting film is superposed on a presensitized plate and subjected to contact exposure, whereby the output is indirectly recorded in the presensitized plate to make a printing plate. This is because it is difficult to develop direct reproduction type printing plates having sensitivities high enough to make printing plates in a practical time using the output of a plotter as the light source (e.g., He-Ne laser, semiconductor laser).

Under these circumstances, electrophotographic photoreceptors are anticipated to be usable as photosensitive materials having such high sensitivities as to provide direct reproduction type printing plates.

As for the printing plate materials (plate precursors) utilizing electrophotography, there have so far been known zinc oxide-resin dispersion type offset printing plate materials disclosed, e.g., in JP-B-47-47610 (the term "JP-B" as used herein means an "examined Japanese patent publication"), JP-B-48-40002, JP-B-48-18325, JP-B-51-15766, JP-B-51-25761, and so on. In using those materials as printing plates, toner images are formed on the materials by electrophotography, and then the materials are dampened with a desensitizing solution (e.g., an acidic aqueous solution containing a ferrocyanide or a ferricyanide) in order to desensitize the nonimage part. Though the thus processed offset printing plates have a printing impression capable of producing in the order of from 5,000 to 10,000 sheets, they are unsuitable for the printing in which a printing impression capable of producing copies in higher than the above-described order is required. Moreover, when designed so as to have compositions suitable for desensitization, the plate materials suffer from deterioration of their electrostatic characteristics and produce images of aggravated qualities. Furthermore, the desensitizing solutions used in making the printing plates have the disadvantage of containing harmful cyanides.

In organic photoconductor-resin coated plate materials as disclosed, e.g., in JP-B-37-17162, JP-B-38-7758, JP-B-46-39405, JP-B-52-2437, etc., electrophotographic photoreceptors of the type which comprise a grained aluminium plate having thereon a photoconductive, electrically insulating layer containing, e.g., an oxazole or oxadiazole compound bonded with a styrene-maleic anhydride copolymer are employed. After toner images are formed on those photoreceptors through electrophotography, the nonimage part is removed by dissolution in an alkaline organic solvent to make a printing plate.

As a representative of the above-described printing plate materials, the Elfasol system is put on sale from Kalle A. G. This system is inferior in resolution because a dry developer is used therein, so it cannot provide high quality images. However, dry developers are, in general, superior in resit quality to etching solutions since they are particles constituted, in general, with a coloring agent and a resin, and measuring from 10 microns to several tens of microns to form a thick toner layer on the image part.

A particle size of toner to form images, as well as known, can be rendered smaller (0.1 to 2 microns) in a liquid developer than in a dry developer, so the liquid developer can provide high quality images excellent in resolution.

However, using a liquid developer in the systems as described above causes a trouble that even the image part tends to be etched due to excellent resolution of the liquid developer upon removal of the nonimage part with an alkaline etching solution As a consequence it follows that images excellent in resolution cannot be obtained in spite of using the liquid developer. On the other hand, the attempt to use materials excellent in etching resistance is attended by the problem that such materials cannot provide high resolution characteristic of a liquid developer because of difficulty in dispersing them. In addition, some of such materials raise another question that because of their insufficient adhesiveness to photoreceptive materials, the formed toner images peel in the form of film from the surface of the photoreceptive materials during the etching procedure, and therefore the materials are of no use as the resist of the image part, notwithstanding their excellency in dispersibility and etching resistance.

For instance, a liquid developer as disclosed in JP-B-52-3306, which contains as the image forming ingredient such a copolymer as to contain vinyl acetate as a main component, is readily dissolved in an alkaline etching solution, so it cannot serve as the resist.

In the case of ethylene copolymers disclosed in JP-A-58-129438 and JP-A-61-180248 (the term "JP-A" as used herein means an "unexamined published Japanese patent application"), the toner layer comes off when soaked in an etching solution though it shows sufficient etching resistance when the surface thereof is attacked by the etching solution. In addition, the ethylene copolymers are known to be very difficult to disperse. Further, copolymers prepared from alkyl(meth)acrylates and styrene or its derivatives are disclosed in JP-A-58-139155, but they are still insufficient to function as resist. Furthermore, though terpolymers prepared from (meth)acrylates, styrenes and acidic group-containing monomers are disclosed in JP-A-58-121047 and JP-A-58-127939, they are also insufficient in resist quality. In particular, the acidic group-containing monomer component has turned out to be extremely disadvantageous when an alkaline etching solution is used. Besides the above-described copolymers, alkyd resins, phenol resins, rosin-modified resins and the like, though used as a trial, were unable to bring about desirable results. Moreover, suitable liquid developers have not yet found out among various commercially available ones.

SUMMARY OF THE INVENTION

A first object of this invention is to provide a positively chargeable liquid developer excellent in quality as a resist to an alkaline etching solution.

A second object of this invention is to provide a positively chargeable liquid developer excellent in dispersion stability and good for long-range use.

A third object of this invention is to provide a positively chargeable liquid developer with high resolving power and excellent image reproducibility.

The above-described objects are attained with a positively chargeable liquid developer to be used in making a printing plate by developing an electrostatic image, which is formed on the surface of a printing plate precursor comprising a conductive base plate having provided thereon an electrophotographic photoreceptive layer, with a liquid developer, and then by decoating the nonimage area, with the liquid developer containing image forming particles comprising a resin prepared by copolymerizing monomers of the following general formula (I), (II) and (III) in a copolymerizing ratio of 0.1-9.9:90-99.8:0.1-10 by weight %, and having a number average molecular weight ranging from $5\times10^3$ to $5\times10^5$ and a softening point ranging from 40° C. to 150° C.

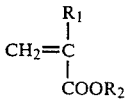
(I)

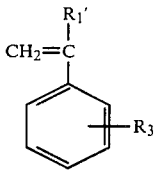
(II)

-continued

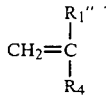
(III)

(wherein $R_1$, $R_1'$ and $R_1''$ each represents a hydrogen atom or a methyl group; $R_2$ represents a straight-chain or branched alkyl group containing 4 to 22 carbon atoms; $R_3$ represents a hydrogen atom, or a straight-chain or branched alkyl group containing 1 to 4 carbon atoms; $R_4$ represents

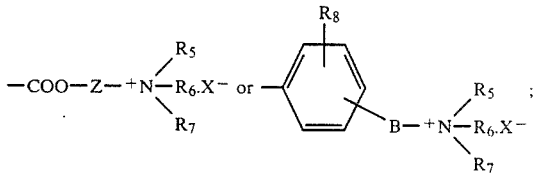

Z and B each represents $-(CH_2)_n-$ (n=1-4), but B may be absent from the group represented by $R_4$; $X^{31}$ represents an anion; $R_5$, $R_6$ and $R_7$ may be the same or different, each being a straight-chain or branched alkyl group containing 1 to 12 carbon atoms, or a hydrogen atom and $R_8$ has the same definition as $R_3$.

Even better results are achieved by using the monomer of the following formula (A) in addition to the above-described monomers represented by the general formulae (I), (II) and (III) in preparing a resin to constitute the image forming particles of this invention in such an amount that a copolymerizing ratio of (A):(I):(II):(III) may come to 5-50:1-25: 48-93:0.1-10 by weight %:

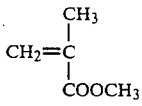
(A)

DETAILED DESCRIPTION OF THE INVENTION

In general a liquid developer to be used in electrophotography comprises a coloring agent, a covering agent, a dispersing agent, a charge controlling agent and an electrically insulating carrier liquid. The coloring agent is not necessarily an essential component in the case where, as in this invention, the developer is used for making a printing plate presursor. The covering agent functions as a component for fixing toner, and the resin of this invention corresponds to this covering agent, that is to say, a fixing agent. The dispersing agent is used for enhancing the dispersion stability of the coloring agent and the covering agent. The charge controlling agent is used for rendering the polarity of the developer clear and controlling the electrostatic capacity of toner particles to be charged, but it is not always required of the developer depending on the kind of the covering, dispersing or coloring agent used.

As for the carrier liquid, a nonpolar liquid with electric resistance of $10^9$ ohm.cm or above can be used.

The resin component of this ivnention is used alone or together with a coloring agent, and forms an image. As characteristics required of this resin, firstly can be cited the stability to an alkali etching solution, that is, the nonsolubility therein. Second, dispersibility can be cited. Third, it is important to possess appropriate thermal characteristics, that is, the fixation facility and nonflowability at room temperature.

Moreover, though it depends on the kind of a printing plate precursor to be used , (particularly on the kind of binding resin employed in the photoreceptive layer of the printing plate precursor), it is necessary to have adhesiveness (including adhesive and fixing properties) to the printing plate precursor so that the toner image layer may not peel apart from the surface of the printing plate precursor during the etching procedure.

For the convenience of explanation, the monomers represented by the general formulae, (I), (II) and (III), which all constitute the copolymer resin of this invention, are named the first constituent, the second constituent and the third constituent, in that order.

The first constituent in the resin of this invention functions as the component for imparting dispersibility to the resin, the second one as resist component to an etching solution, and the third one as the component for giving positive chargeability to the resin.

Because of affinity for carrier liquid in the developer, the first component can produce an effect on enhancement of dispersibility even when it is contained in a small fraction. Lengthening the carbon chain of the alkyl group tends to make an elevating effect on dispersibility more appreciable. However, increasing the fraction of the first component deteriorates the resist quality because it tends to have affinity for etching solution also.

The second constituent does not have affinities for carrier liquid and etching solution, and functions as resist component. Therefore, resist quality is enhanced as the fraction of this constituent is increased.

The third constituent functions as the component for giving positive chargeability to the resin, and a characteristic thereof consists in not exerting any bad influence on the resist quality.

Owing to this third constituent, the resin of this invention can easily gain a desired quantity of charge by itself or by combined use with a charge controlling agent. And the quantity of the charge can be controlled. Accordingly, a coloring agent, which has often been used for charging, is not necessarily required. Further, since a liquid developer for printing plate accomplishes for the most part its purpose if only it functions as the resist of the image part to an etching solution when the nonimage part is decoated after development, a coloring agent is not always needed. Some coloring agents exert an evil influence on the resist quality, and some don't have any bad influence thereon until they are used in a large amount (which refers to the case in which a ratio of the coloring agent to the resin is great).

When images are formed with the developers prepared using the resins alone in accordance with this invention, they are of white color in many cases. Therefore, coloring a printing plate precursor can greatly enhance the checkup facility of the plate.

The resist quality of the resin, though it depends on the copolymerizing ratio among these three constituents, is influenced by molecular weight also. In addition to the resist quality, the dispersibility and the fixability constitute important factors in the resin for the developer. Therefore, the resin of this invention must be designed by fully considering these factors.

A copolymerizing ratio, (I):(II):(III), in the resin which can collectively satisfy these required properties is within the range of 0.1–9.9:90–99.8:1.0–10 by wt %.

When the fraction of the first constituent is increased beyond the upper limit of the above-described range, the resist quality suffers deterioration since the affinity for a carrier liquid and that for an etching solution are heightened at the same time, though the dispersibility is increased to some extent. On the other hand, when the second constituent is below the lower limit of the above-described range, the first constituent is necessarily increased, so the resulting resin also suffers from the above-described defect.

When the monomer (A) is used as the fourth constituent in this invention, it functions as the resist component to an etching solution in combination with the second constituent.

Of these resist components, one which corresponds to the second constituent exerts its effects mainly on the resist quality, while methylmethacrylate corresponding to the fourth constituent has not only an effect on the resist quality, but also functions in facilitating the dispersion or the grinding of the resin as a whole. The liquid developer, as described hereinafter, is generally prepared through wet dispersion. This wet dispersion is carried out with such media as glass beads. In the course of wet dispersion, the toner component, that is the resin alone or the mixture of the resin with the coloring agent, is ground by the impact force of moving media. We have found out therein that the resin containing methylmethacrylate as a copolymerizing component can be ground to finely divided particles more readily than a methylmethacrylate-free resin.

Though a sweeping statement cannot be made because the fixability and the adhesiveness to the printing plate precursor depend on not only the resin in the developer but also characteristics of the photoreceptor to be used in combination, they depend greatly on the copolymerizing ratio among the constituents and the molecular weight.

When the monomer (A) is used as the fourth constituent, it is desirable that a copolymerizing ratio, (A):(I):(II):(III), should be 5–50:1–25:48–93:0.1–10 by wt %.

As for the molecular weight, a number average molecular weight ranges from $5\times10^3$ to $5\times10^5$, preferably from $1\times10^4$ to $2\times10^5$ on the polystyrene basis according to GPC method. When the molecular weight is below the above-described lower limit, the quality as the resist to an etching solution is deteriorated, whereas when it is beyond the above-described upper limit the softening point is raised to lower the fixability, and the dispersion becomes difficult.

The softening point is preferably within the range of 40° C. to 150° C. When the softening point is lower than the above lower limit, the resulting toner image flows at room temperature, or collapses during printing. On the other hand, when it is higher than the above upper limit, fixation becomes difficult, so more energy is required for fixation. Accordingly, such high softening points are disadvantageous in practical use.

The term softening point used herein refers to the softening starting temperature determined by the method described in JP-A-60-134792.

As examples of an anionic component of the quaternary salt monomer as the third constituent, mention may be made of a halogen ion, monomethylsulfuric acid ion, and alkybenzenesulfonic acid ions such as p-toluenesulfonic acid ion.

In addition, various kinds of anions disclosed in JP-A-59-137960 can be cited as instances.

As examples of $R_2$ in the monomer (I) to constitute the copolymer resin of this invention, mention may be made of an n-butyl group, isobutyl group, t-butyl group, n-amyl group, pentyl group, hexyl group, heptyl group, octyl group, 2-ethylhexyl group, nonyl group, decyl group, dodecyl group, tetradecyl group, hexadecyl group, octadecyl group, eicosyl group, docosyl group and so on. Among these groups, those containing 8 or more carbon atoms are preferred over others.

As examples of $R_3$ and $R_8$ in the monomers (II) and (III), mention may be made of a methyl group, ethyl group, n-propyl group, isopropyl group, n-butyl group, isobutyl group, t-butyl group and a hydrogen atom. Among these groups, a hydrogen atom and a methyl group are preferred over others.

As examples of $R_5$, $R_6$ and $R_7$ in the monomer (III), mention may be made of a methyl group, ethyl group, n-propyl group, isopropyl group, n-butyl group, isobutyl group, n-amyl group, pentyl group, hexyl group, heptyl group, octyl group, 2-ethylhexyl group, nonyl group, decyl group, a hydrogen atom and so on.

Specific examples of the copolymer resins of this invention are illustrated below. However, the invention should not be construed as being limited to these examples. Additionally, in the following structural formulae, all copolymerizing ratios are by wt %, all fractions are given in prepared quantities, and all molecular weights are expressed in terms of the number average molecular weight on the polystyrene basis according to GPC method.

Examples of the Copolymer Resins of this Invention

1.

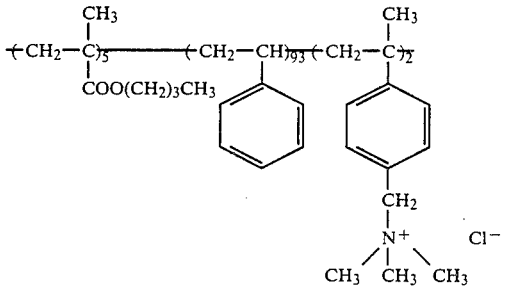

molecular weight: $3.1 \times 10^4$
softening point: 98° C.

2.

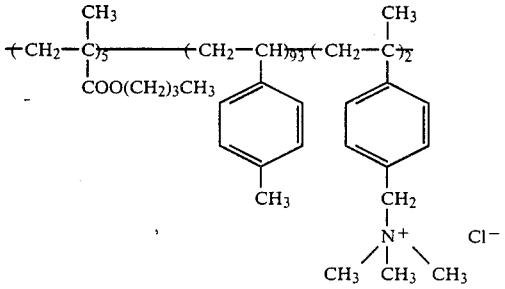

molecular weight: $3.3 \times 10^4$
softening point: 96° C.

3.

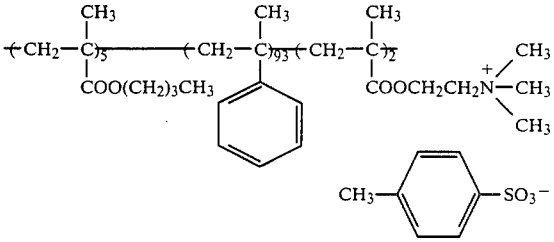

molecular weight: $3.4 \times 10^4$
softening point: 97° C.

-continued
4.
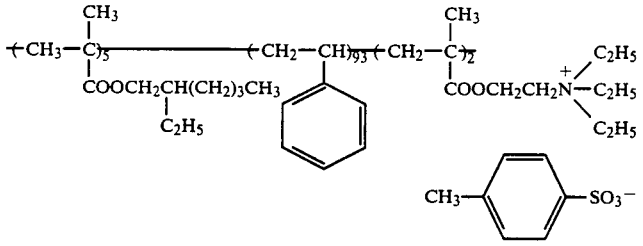
molecular weight: $3.2 \times 10^4$
softening point: 93° C.
5.
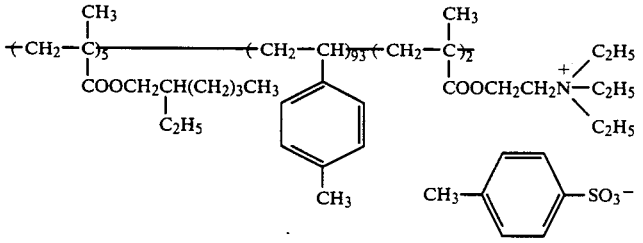
molecular weight: $3.3 \times 10^4$
softening point: 89° C.
6.
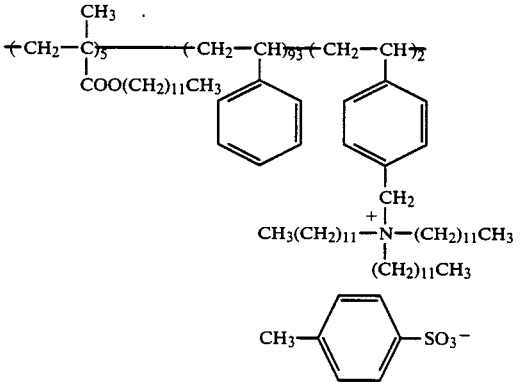
molecular weight: $4.3 \times 10^4$
softening point: 86° C.
7.
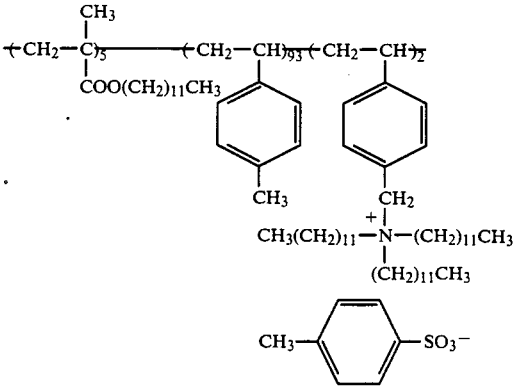
molecular weight: $5.1 \times 10^4$
softening point: 91° C.

-continued
8.
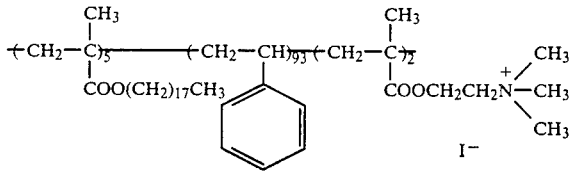
molecular weight: $3.5 \times 10^4$
softening point: 81° C.
9.
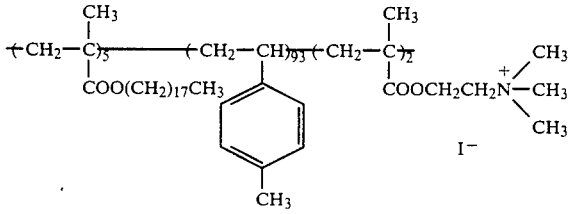
molecular weight: $3.7 \times 10^4$
softening point: 79° C.
10.
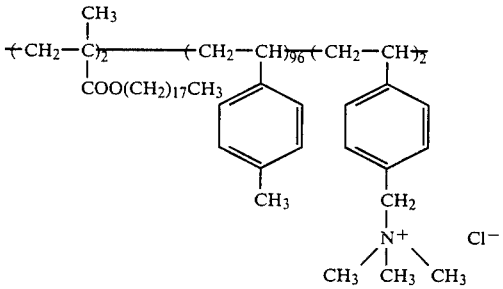
molecular weight: $4.0 \times 10^4$
softening point: 84° C.
11.
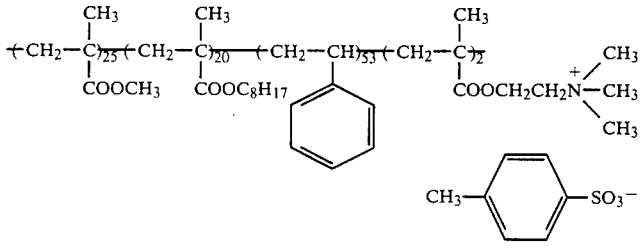
molecular weight: $3.2 \times 10^4$
softening point: 76° C.
12.
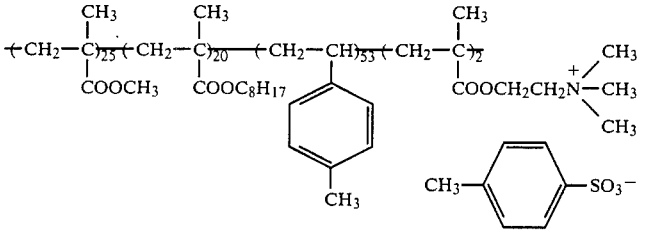
molecular weight: $2.6 \times 10^4$
softening point: 73° C.

-continued
13.
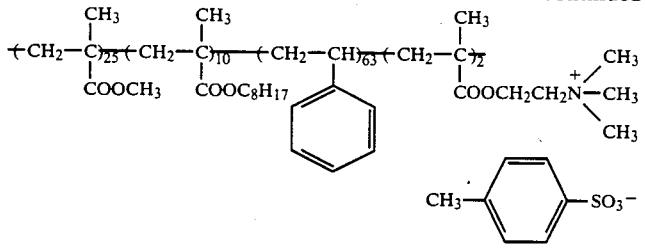
molecular weight: $1.8 \times 10^4$
softening point: 78° C.
14.
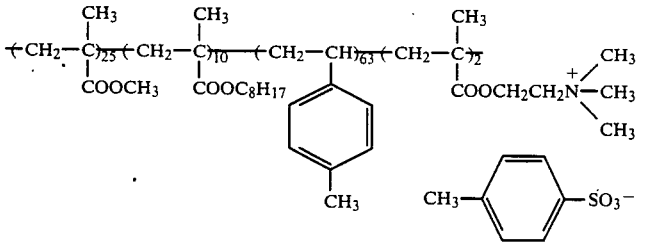
molecular weight: $2.1 \times 10^4$
softening point: 76° C.
15.
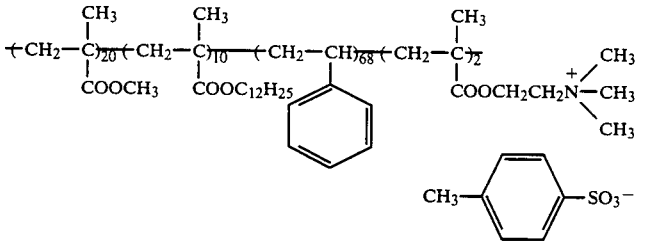
molecular weight: $2.8 \times 10^4$
softening point: 78° C.
16.
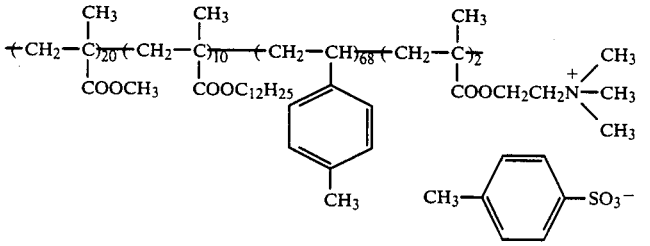
molecular weight: $3.3 \times 10^4$
softening point: 78° C.
17.
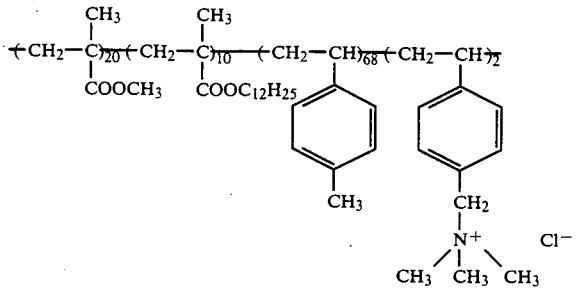
molecular weight: $3.9 \times 10^4$
softening point: 79° C.

-continued
18.
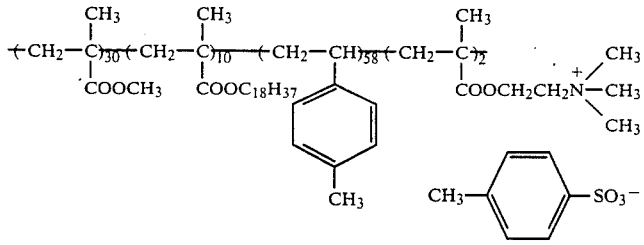
molecular weight: $2.5 \times 10^4$
softening point: 72° C.
19.
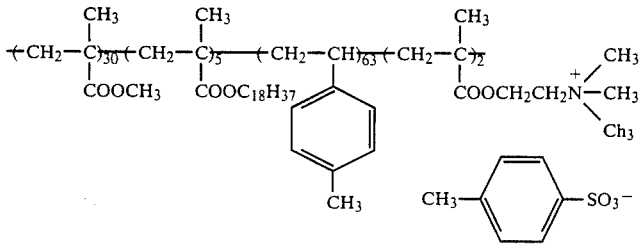
molecular weight: $2.5 \times 10^4$
softening point: 81° C.
20.
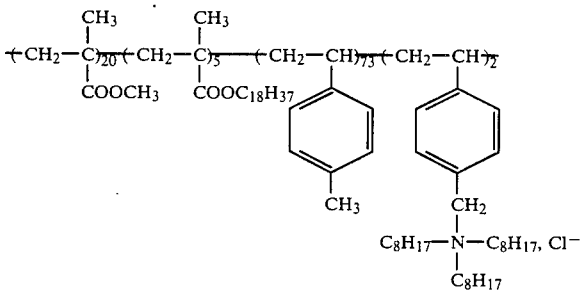
molecular weight: $2.3 \times 10^4$
softening point: 82° C.
Examples of Copolymer Resins for Comparison
1.
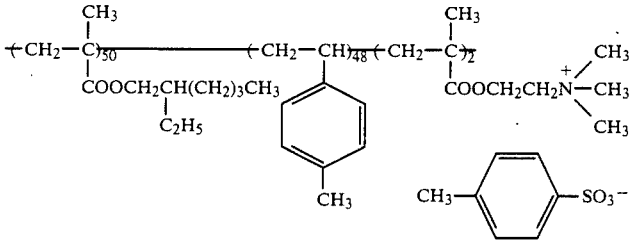
molecular weight: $2.5 \times 10^4$
softening point: 55° C.
2.
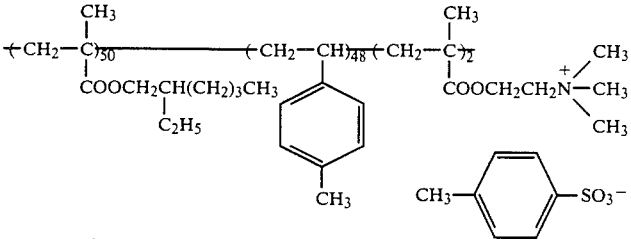
molecular weight: $3.0 \times 10^4$
softening point: 43° C.

-continued
3.
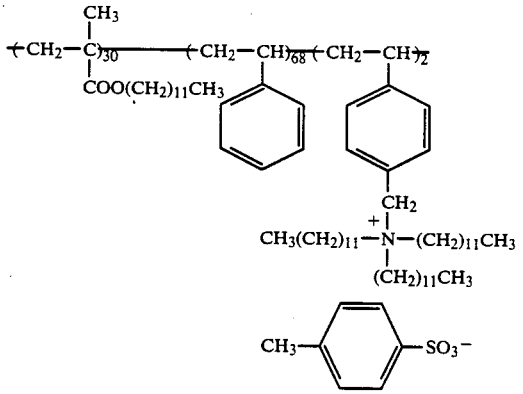
molecular weight: $2.8 \times 10^4$
softening point: 58° C.
4.
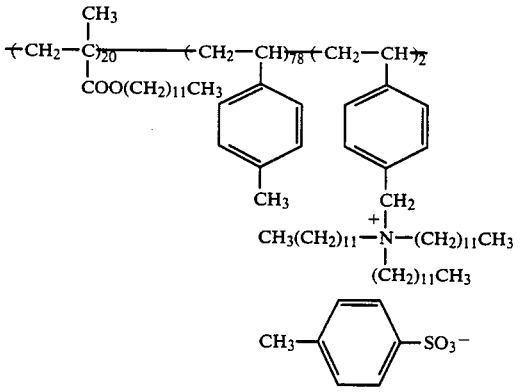
molecular weight: $4.1 \times 10^4$
softening point: 67° C.
5.
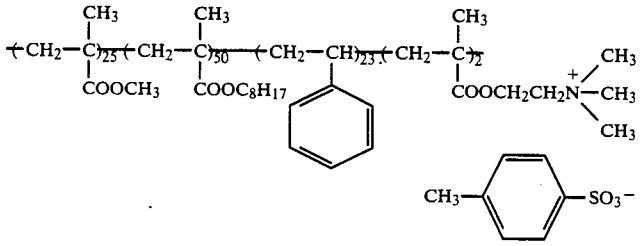
molecular weight: $1.8 \times 10^4$
softening point: 68° C.
6.
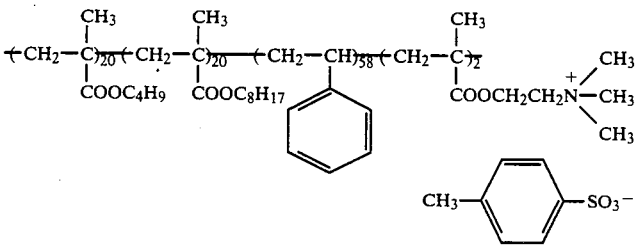
molecular weight: $3 \times 10^4$
softening point: 48° C.

-continued

7.

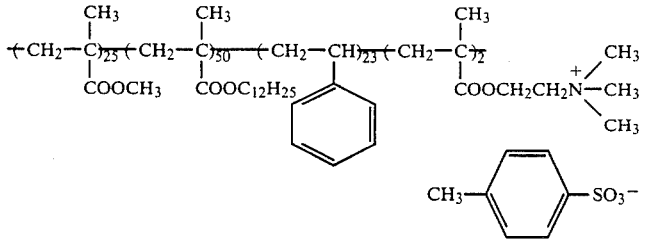

molecular weight: $3.3 \times 10^4$
softening point: 52° C.

8.

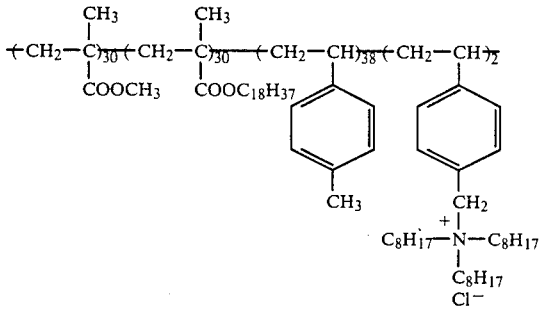

molecular weight: $1.5 \times 10^4$
softening point: 53° C.

These comparative resins are those departing from the criterion of this invention.

These resins can be synthesized by copolymerizing the above-described monomer groups in prescribed fractions.

As for the polymerization method, known conventional ones, such as solution polymerization, suspension polymerization, precipitation polymerization, emulsion polymerization and so on, can be employed. In solution polymerization, for instance, a copolymer solution can be obtained by dissolving monomers in a solvent, such as benzene, toluene, etc., in prescribed fractions, and adding thereto a radical polymerization initiator, such as azobisisobutyronitrile, benzoyl peroxide, lauryl peroxide or the like. The resulting solution is dried or added to a poor solvent to yield the intended copolymer. In suspension polymerization, on the other hand, the monomers are suspended in the presence of a dispersing agent, such as polyvinyl alcohol, polyvinyl pyrrolidone or the like, and copolymerized in the presence of a radical polymerization initiator. Therein, a chain transfer agent, such as mercaptanes (e.g., lauryl mercaptane), can be used for the purpose of molecular weight control.

As a carrier liquid in this invention, nonaqueous solvents with an electric resistance of $1 \times 10^9$ ohm.cm or more and a dielectric constant of 3 or less can be employed. As examples of such nonaqueous solvents, mention may be made of straight-chain or branched aliphatic hydrocarbons, alicyclic hydrocarbons, aromatic hydrocarbons, and halogenated hydrocarbons. From the standpoints of volatility, safety, environmental pollution, odor and so on, octane, isooctane, decane, isodecane, dodecane, isododecane, nonane, and petroleum solvents of the isoparaffin type, e.g., Isopar E, Isopar G, Isopar H, Isopar L ("Isopar" is the trade name given by Exxon Co.), Solvesso 100 (made by Exxon Co.), Shell Sol 71 (made by Shell Research Ltd.), etc., are preferred.

A coloring agent, though not always needed in this invention, can optionally be used.

Known pigments or/and dyes which have so far been used for liquid developers can be employed as a coloring agent in this invention also. Specific examples thereof include Hansa Yellow (C.I. 11680), Benzidine Yellow G (C.I. 21090), Benzidine Orange (C.I. 21110), Fast Red (C.I. 37085), Brilliant Carmine 3B (C.I. 16015-Lake), Phthalocyanine Blue (C.I. 74160), Phthalocyanine Green (C.I. 74260), Victoria Blue (C.I. 42595-Lake), Spirit Black (C.I. 50415), Oil Blue (C.I. 74350), Alkali Blue (C.I. 42770A), Fast Scarlet (C.I. 12315), Rhodamine 6B (C.I. 45160), Fast Sky Blue (C.I. 74200-Lake), Nigrosine (C.I. 50415), carbon black, and so on. In addition, surface-processed pigments, e.g., Nigrosine-dyed carbon black, polymer-grafted carbon, etc., can be used.

Charge controlling agents which can be used in this invention include known conventional ones. For example, metal salts of fatty acids, such as naphthenic acid, octenic acid, oleic acid, stearic acid, etc., metal salts of sulfosuccinic acid esters, oil-soluble metal salts of sulfonic acids disclosed, e.g., in JP-B-45-556, JP-B-52-37435 and JP-A-52-37049, metal salts of phosphoric acid esters disclosed in JP-B-45-9594, metal salts of abietic acid or hydrogenated abietic acid disclosed in JP-B-48-25666, calcium salts of alkylbenzene sulfonic acids disclosed in JP-B-55-2620, and metal salts of aromatic carboxylic or sulfonic acids disclosed, e.g., in JP-A-52-107837, JP-A-52-38937, JP-A-57-90643 and JP-A-57-139753 can be used in this invention.

For the purpose of heightening the dispersibility and the stability of the liquid developer of this invention, known dispersing agents can be used. The dispersing agents which can be used are resins for heightening the dispersibility of toner through their dissolution or swelling in a carrier liquid, with specific examples including rubbers, such as styrene-butadiene rubber, vinyltoluene rubber, butadiene rubber, butadieneisoprene rubber, etc., polymers prepared from acryl monomers containing a long chain alkyl group, such as 2-ethylhexyl(meth-)acrylate, lauryl(meth)acrylate, stearyl(meth)acrylate, etc., and copolymers prepared form the above-cited acryl monomers and other monomers (e.g., styrene, methyl(meth)acrylate, ethyl(meth)acrylate, propyl(-meth)acrylate, etc., which each may assume the form of graft copolymer or block-copolymer. Among these dispersing agents, those of synthetic rubber type are more effective than others, and styrene-butadiene random or block copolymer can be used as a highly effective dispersing agent.

When a coloring agent is not used, the resin of this invention is ground with a pin mill or the like, and then subjected to wet dispersion, if desired, together with a dispersing polymer. In another manner, the resin is dissolved in a prosolvent, and then reprecipitated from a nonsolvent, thus achieving the formation of fine particles. Further, it is feasible to directly form resin particles with a desired size according to an emulsion or dispersion polymerization process.

On the other hand, in the case of using a pigment or/and a dye as a coloring agent, the coloring agent and the above-described covering agent are firstly heated up to the softening point of said covering agent, kneaded with a Bumbury's mixer, a cokneader, a kneader, a three-rod roll mill or the like, and then cooled to prepare a blend. In kneading these agents, a variety of solvents and soon can be added. The blend of a coloring agent and a covering agent as described above can be obtained in another manner, wherein both agents are kneaded in their prosolvent by means of a ball mill, a paint shaker or the like, and then dried or added to a nonsolvent to yield the intended blend.

The thus obtained blend is ground in a dried condition with a Rotoplex, a pin mill or the like, and then subjected to wet dispersion in the presence of a dispersing agent using one of various kinds of dispersing machines, resulting in the formation of a concentrated liquid developer. A solvent to be used at the time of wet dispersion may be a carrier liquid or an additional solvent, e.g., toluene, acetone or so on.

The thus obtained concentrated toner solution is dispersed into a nonaqueous solvent containing a charge controlling agent to prepare a liquid developer for electrophotography. The concentration of toner particles (covering agent) in the developer, though it does not have any particular limitation, ranges generally from 0.1 to 100 g, preferably from 0.5 to 20 g, per liter of carrier liquid. In the case where a coloring agent is used in the toner particles, the covering agent can be used in an amount of 0.5 to 20 parts by weight, preferably 1 to 10 parts by weight, per part by weight of the coloring agent.

The dispersing agent is added in an amount, in general, from 0.1 to 50 g, preferably from 0.1 to 10 g, per liter of the carrier liquid.

The charge controlling agent may be added in a manner other than the above-described one. That is, it may be added in the course of kneading or wet dispersion. Further, it may be added during both courses. It is desirable that an amount of the charge controlling agent added should be controlled to 0.001 to 10 g, preferably 0.01 to 1 g, per liter of the developer.

Conductive base plates for printing plates to which the liquid developer of this invention can be applied are those having hydrophilic surfaces, with specific examples including plastic sheets with conductive surfaces, paper sheets to which a high permeability barrier to solvents- and electric conductivity are imparted, an aluminium plate, a zinc plate, bimetal plates such as a copper-aluminium plate, a copper-stainless steel plate, a chromium-copper plate, etc., and trimetal plates such as a chromium-copper-aluminium plate, a chromium-lead-iron plate, a chromium-copper-stainless steel plate, etc. A preferred thickness of such a conductive base plate ranges from 0.1 to 3 mm, particularly from 0.1 to 0.5 mm. Of these base plates, an aluminium plate provided with an anodically oxidized coat is preferred over others.

In order to remove a rolling oil from the surface of an aluminium plate, the plate is optionally subjected to a degreasing treatment with a surface active agent or an alkaline aqueous solution and a graining treatment prior to anodic oxidation.

Methods for the graining treatment include the method of roughening the surface by mechanical means, the method of dissolving the surface by electrochemical means, and the method of selectively dissolving the surface by a chemical means. In mechanically roughening the surface, known methods which are called a ball graining method, a brush graining method, a blast graining method, a buff graining method and so on can be employed. As for the electrochemical method, the surface is roughened in an electrolytic solution of hydrochloric acid or nitric acid by passing alternating or direct current therethrough. Also, the combination of these two methods can be employed, as disclosed in JP-A-54-63092.

A preferred coverage of the anodic coat ranges from 0.1 to $10^2$ g/m$^2$, particularly from 1 to 6 g/m$^2$.

Photoconductive materials to constitute electrophotographic photoreceptive layers of the printing plates which can be used in this invention include a great number of inorganic and organic compounds which have so far been known to possess photoconductivity.

As examples of inorganic photoconductive materials, mention may be made of selenium, selenium alloys, amorphous silicon, Cd, CdS, CdSe, ZnO, ZnS, and so on.

As for the organic photoconductive materials, there are cited as examples high molecular weight ones including:

(1) polyvinylcarbazole and its derivatives disclosed in JP-B-34-10966, (2) vinyl polymers disclosed in JP-B-43-18674 and JP-B-43-19192, with specific examples including polyvinyl-pyrene, polyvinylanthracene, poly-2-vinyl-4-(4-dimethylaminophenyl)-5-phenyl-oxazole, poly-3-vinyl-N-ethylcarbazole, etc., (3) polymer disclosed in JP-B-43-19193, such as polyacenaphthylene, polyindene, acenaphthylene-styrene copolymer, and so on, (4) condensed resins as disclosed in JP-B-56-13940 and so on, such as pyrene-formaldehyde resin, bromopyrene-formaldehyde resin, ethylcarbazole-formaldehyde resin and so on, and (5) various kinds of triphenylmethane polymers disclosed in JP-A-56-90883 and JP-A-56-161550; and low molecular weight ones including:

(6) triazole derivatives disclosed in U.S. Pat. No. 3,112,197 and so on, (7) oxadiazole derivatives disclosed in U.S. Pat. No. 3,189,447 and so on, (8) imidazole derivatives disclosed in JP-B-37-16096 and so on, (9) polyarylalkane derivatives disclosed in U.S. Pat. No. 3,615,402, U.S. Pat. No. 3,820,989, U.S. Pat. No. 3,542,544, JP-B-45-555, JP-B 51-10983, JP-A-51-93224, JP-A-55-108667, JP-A-55-156953, JP-A-56-36656 and so on, (10)pyrazoline derivatives and pyrazoline derivatives disclosed in U.S. Pat. No. 3,180,729, U.S. Pat. No. 4,278,746, JP-A-55-88064, JP-A-55-88065, JP-A-49-105537, JP-A-55-51086, JP-A-56-80051, JP-A-56-88141, JP-A-57-45545, JP-A-54-112637, JP-A-55-74546 and so on, (11)phenylenediamine derivatives disclosed in U.S. Pat. No. 3,615,404, JP-B-51-10105, JP-A-54-83435, JP-A-54-110836, JP-A-54-119925, JP-B-46-3712, JP-B-47-28336 and so on, (12)arylamine derivatives disclosed in U.S. Pat. No. 3,567,450, JP-B-49-35702, West German Patent (DAS) No. 1,110,518, U.S. Pat. No. 3,180,703, U.S. Pat. No. 3,240,597, U.S. Pat. No. 3,658,520, U.S. Pat. No. 4,232,103, U.S. Pat. No. 4,175,961, U.S. Pat. No. 4,012,376, JP-A-55-144250, JP-A-56-119132, JP-B-39-27577, JP-A-56-22437, and so on.

(13)amino-substituted chalcone derivatives disclosed in U.S. Pat. No. 3,526,501, (14)N,N-bicarbazyl derivatives disclosed in U.S. Pat. No. 3,542,546 and so on, (15)oxazole derivatives disclosed in U.S. Pat. No. 3,257,203 and so on, (16)styrylanthracene derivatives disclosed in JP-A-56-46234 and so on, (17)fluorenone derivatives disclosed in JP-A-54-110837 and so on, (18)hydrazone derivatives disclosed in U.S. Pat. No. 3,717,462, JP-A-54-59143 (corresponding to U.S. Pat. No. 4,150,987), JP-A-55-52063, JP-A-55-52064, JP-A-55-46760, JP-A-55-85495, JP-A-57-11350, JP-A-57-148749, JP-A-57-104144, JP-A-60-186847 and so on, (19)benzidine derivatives disclosed in U.S. Pat. No. 4,047,948, U.S. Pat. No. 4,047,949, U.S. Pat. No. 4,265,990, U.S. Pat. No. 4,273,846, U.S. Pat. No. 4,299,897, U.S. Pat. No. 4,306,008 and so on, (20)stilbene derivatives disclosed in JP-A-58-190953, JP-A-59-95540, JP-A-59-97148, JP-A-59-195658, JP-A-62-36674 and so on, (21)monoazo, bisazo and trisazo pigments disclosed in U.S. Pat. No. 4,436,800, U.S. Pat. No. 4,439,506, JP-A-47-37543, JP-A-58-123541, JP-A-58-192042, JP-A-60-179746, JP-A-61-148453, JP-A-61-238063, JP-B-60-5941, JP-B-60-45664 and so on, (22)phthalocyanine pigments including metallophthalocyanines and metal-free phthalocyanines, as disclosed in U.S. Pat. Nos. 3,397,086 and 4,666,802, and so on, (23)perylene pigments disclosed in U.S. Pat. No. 3,371,884 and so on, (24)indigo and thioindigo derivatives disclosed in British Pat. No. 2,237,608 and so on, (25)quinacridone pigments disclosed in British Pat. No. 2,237,680 and so on, (26)polycyclic quinone pigments disclosed in British Pat. No. 2,237,678, JP-A-59-184348, JP-A-52-738 and so on, (27)bisbenzimidazole pigments disclosed in JP-A-47-30331 and so on, (28)squalium salt type pigments disclosed in U.S. Pat. Nos. 4,396,610 and 4,644,082, and so on, and (29)azulenium salt type pigments disclosed in JP-A-59-53850, JP-A-61-212642 and so on.

These organic photoconductive materials may be used in combination of two or more thereof.

Specific examples of sensitizing dyes suitable for the above-cited photoconductive materials include triarylmethane dyes such as Brilliant Green, Victoria Blue B, Methyl Violet, Crystal Violet, Acid Violet 6B, etc.; xanthene dyes such as rhodamine B, Rhodamine 6G, Rhodamine G Extra, Eosine S, Erythrosine, Rose Bengal, Fluoreceine, etc.; thiadene dyes such as Methylene Blue; Astrazone dyes such as C.I. Basic Violet 7; cyanine dyes; pyrilium dyes such as 2,6-diphenyl-4-(N,N-di-methylaminophenyl)thiapyrilium perchlorate, benzopyrilium salts, etc.; and so on.

Although some of photoconductive compounds for the printing plates to be used in this invention have a film-forming ability by themselves, it is a general means to use a binding resin for imparting the film-forming ability. Since it is necessary in this invention to decoat the nonimage part with an alkaline etching solution after development with the liquid developer, binding resins soluble in the etching solution or dispersible therein through their swelling phenomenon must be employed. In addition, they must have excellent adhesiveness to resins to be used for the toner of this invention.

The expression "excellent adhesiveness" as used herein means such a condition that the toner image does not peel in the filmy from from the photoconductive layer surface of the printing plate during the etching procedure.

Accordingly, binding resins which can be used in this invention include copolymers produced from vinyl monomers such as acrylates, methacrylates, styrene, vinyl acetate, etc., and carboxylic acid or acid anhydride group-containing monomers such as acrylic acid, methacrylic acid, itaconic acid, crotoric acid, maleic acid, maleic anhydride, phthalic anhydride, etc., with specific examples including a copolymer of styrene and maleic anhydride, copolymers of styrene and monoalkyl esters of maleic anhydride, methacrylic acid/methacrylate copolymers, styrene/methacrylic acid/methacrylate copolymers, acrylic acid/methacrylate copolymers, styrene/acrylic acid/methacrylate copolymers, vinyl acetate/crotonic acid copolymers, vinyl acetate/crotonic acid/methacrylate copolymers, and so on; copolymers containing two or more of monomer units selected from among methacrylic acid amide, vinylpyrrolidone, phenolic hydroxy group-containing monomers, sulfo group-containing monomers, sulfonamido group-containing monomers and sulfonimido group-containing monomers; phenol resins; partially saponified vinyl acetate resins; xylene resins; and vinyl acetal resins such as polyvinyl butyral, etc.

The copolymers containing acid anhydride group- or carboxylic acid group-containing monomers as copolymerizing components, and phenol resins can be used to advantage, because they can achieve higher charge retentivity when used for the photoconductive, electrically insulating layer of an electrophotographic type printing plate.

As for the copolymers containing as a copolymerizing component an acid anhydride group-containing monomer, a copolymer of styrene and maleic anhydride is preferred. In addition, half esters of this copolymers can be preferably used.

As for the copolymers containing as a copolymerizing component a carboxylic acid group-containing monomer, copolymers containing not less than two kinds of copolymerizing components selected from acrylic acid or methacrylic acid, and an alkylacrylate or alkylmethacrylate, an arylacrylate or arylmethacrylate, or/and an aralkylacrylate or aralkylmethacrylate are preferred. In addition, a copolymer of vinyl acetate and crotonic acid, and a terpolymer of vinyl acetate, a vinyl ester of carboxylic acid containing 2 to 18 carbon atoms and crotonic acid can be cited as preferred examples. Of phenol resins, novolak resins prepared from phenol, o-cresol, m-cresol or p-cresol, and formaldehyde or acetoaldehyde by condensing them under an acidic condition are particularly preferred. These binding resins may be used alone or as a mixture of two or more thereof. When a photoconductive compound and a binding resin are used together, decreasing the content of the photoconductive compound lowers the photoreceptivity. Therefore, the photoconductive compound is used in an amount more than 0.05 part by weight, preferably more than 0.1 part by weight, per 1 part by weight of the binding resin. A thickness of the photoconductive layer is controlled to 0.1 to 30 microns, preferably 0.5 to 10 microns, because when the photoconductive layer is too thin, it cannot gain a charge quantity necessary for development, whereas when it is too thick, etching in the horizontal direction, or a so-called side etching, occurs during etching to end in production of an undesirable image.

A printing plate to be used in this invention can be obtained by coating a photoconductive composition as described above on a conductive base as described above. The coating composition can be obtained by dissolving various ingredients to constitute the photoconductive layer in a proper solvent. When ingredients insoluble in the solvent, e.g., pigments, are used, they are ground to particles having a size of 5 to 0.1 micron to be dispersed into the solvent using a dispersing machine, such as a ball mill, a paint shaker, a Dyno mill, an Attritor or so on. A binding resin and other additives to be used for the photoconductive layer can be added during or after the dispersion of pigments. The thus prepared coating composition is coated on a base using a known coating method, such as a spin coating method, a blade coating method, a knife coating method, a reverse roll coating method, a dip coating method, a rod bar coating method, a spray coating method or so on, and dried to obtain an electrophotographic type printing plate. Suitable examples of solvents for preparing the coating composition include halogenated hydrocarbons, such as dichloromethane, dichloroethane, chloroform, etc.; alcohols, such as methanol, ethanol, etc.; ketones, such as acetone, methyl ethyl ketone, cyclohexanone, etc.; glycol ethers, such as ethyleneglycol monomethyl ether, 2-methoxyethyl acetate, etc.; ethers, such as tetrahydrofuran, dioxane, etc.; esters, such as ethyl acetate, butyl acetate, etc.; and so on.

A printing plate to be used in this invention can be prepared in a known general process. Specifically, the process for forming an electrostatic latent image comprises substantially uniform electrification in the dark, and imagewise exposure. As examples of usable exposure methods, mention may be made of scanning exposure using semiconductor lasers, a He-Ne laser or the like, reflex type imagewise exposure using a xenon lamp, a tungsten lamp, a fluorescent lamp or the like as a light source, and contact exposure through a transparent positive film. Then, the foregoing electrostatic latent image is developed with the liquid developer of this invention. The toner image formed can be fixed using a known fixing method, such as heat fixation, solvent fixation or so on, if needed. The thus obtained toner image is made to function as a resist, and thereby the nonimage part in the electrophotographic photoreceptive layer is removed with an etching solution, resulting in the production of a printing plate.

An etching solution which is preferably used for the printing plate of this invention is an aqueous solution of an organic or inorganic acid, base or its salt, or a mixture of this aqueous solution with a water-miscible organic solvent.

Ingredients to constitute the etching solution, though they should be selected by considering the solubility of the photoreceptive layer therein in addition to the quality of the toner layer as a resist, generally include the following ones.

Sodium hydroxide, potassium hydroxide, sodium carbonate, sodium silicate, potassium silicate, sodium metasilicate, potassium metasilicate, sodium phosphate, potassium phosphate, ammonia and aminoalcohols such as monoethanolamine, diethanolamine, triethanolamine and the like are well known. Suitable organic solvents miscible with aqueous solutions of the foregoing compounds are alcohols, ketones, esters, ethers, and so on. Specific examples of alcohols include lower aliphatic and aromatic alcohols, such as methanol, ethanol, propanol, butanol, benzyl alcohol, phenetyl alcohol, etc.; cellosolves, such as ethylene glycol, diethylene glycol, triethylene glycol, polyethylene glycol, etc.; aminoalcohols, such as monoethanolamine, diethanolamine, triethanolamine, etc.; and so on. Specific examples of ketons include acetone, methyl ethyl ketone, methyl isobutyl ketone, and so on. Specific examples of esters include ethyl acetate, isopropyl acetate, n-propyl acetate, sec-butyl acetate, isobutyl acetate, n-butyl acetate, 1-acetoxy-2-methoxyethane, ethylene glycol diacetate, and so on. Specific examples of ethers include ethyl ether, tetrahydrofuran, dioxane, 2-methoxyethanol, ethylene glycol dimethyl ether, and so on. These organic solvents, though they can be mixed with the foregoing aqueous solutions in any proportion, are preferably used in proportions of not more than 90 wt % to the mixed solutions. To these etching solutions may be added a surface active agent, a deforming agent, a coloring agent and so on, if desired.

Representative examples of a composition of the etching solution, though it should be determined depending on the kind of a binding resin used in the electrophotographic photoreceptor and the kind of a resin used in the toner, are given below. Therein, all parts are by weight.

| Composition of Etching Solution: | | |
|---|---|---|
| (1) | Potassium silicate | 40 parts |
| | Potassium hydroxide | 10 parts |
| | Benzyl alcohol | 10 parts |
| | Ethanol | 90 parts |
| | Water | 800 parts |
| (2) | Potassium silicate | 40 parts |
| | Phenetyl alcohol | 20 parts |
| | Benzyl alcohol | 40 parts |
| | Water | 800 parts |
| (3) | DP-4* | 1 part |
| | Ethanol | 1 part |
| | Water | 7 parts |

*DP-4: Developer for PS plate, products of Fuji Photo Film Co., Ltd.

SYNTHESIS EXAMPLES

(1) Synthesis Process of polymer 4

In a reaction container equipped with a reflux condenser, a propeller stirrer and a nitrogen-introducing tube, 200 g of toluene, 10 g of 2-ethylhexylmethacrylate, 186 g of styrene and 4 g of N,N-diethylethylmethacrylate were placed, and heated up to 70° C., in a stream of nitrogen, Thereto, 2,2-azobis(2,4-dimethylvaleronitrile) as a polymerization initiator was added in a proportion of 1 mol % to the above-described monomers, and the polymerization reaction was run for 6 hours at 70° C. Then, 10 g of methyl p-ethylbenzenesulfonate was further added thereto, and the heating was continued for one hour. Thereafter, the reaction mixture was cooled to room temperature, followed by reprecipitation from 5 liter of methanol. The precipitate was dried in vacuo at 50° C. Thus, the intended copolymer was obtained.

(2) Synthesis Process of Polymer 11

In a reaction container equipped with a reflux condenser, a propeller stirrer and a nitrogen-introducing tube, 200 g of toluene, 50 g of methylmethacrylate, 40 g of n-octylmethacrylate, 106 g of styrene and 4 g of N,N-dimethylethylmethacrylate were placed, and heated up to 70° C., in a stream of nitrogen. Thereto, 2,2-azobis(2,4-dimethylvaleronitrile) as a polymerization initiator was added in a proportion of 1 mol % to the above-described monomers, and the polymerization reaction was run for 6 hours at 70° C. Then, 8 g of methyl p-toluenesulfonate was further added thereto, and the heating was continued for one hour. Thereafter, the reaction mixture was cooled to room temperature, followed by reprecipitation from 5 liter of methanol. The precipitate was dried in vacuo at 50° C. Thus, the intended copolymer was obtained.

Other copolymers are synthesized according to the same manner as described above.

The present invention will now be illustrated in greater detail by reference to the following examples. However, the invention should not be construed as being limited to these examples. Additionally, in the following examples, all parts are by weight.

EXAMPLE 1

Production of Printing Plate Precursor

The surface of a JIS 1050 aluminium sheet was grained with a rotary nylon brush using a pumice-water suspension as abrasives. The thus achieved surface roughness (expressed in terms of the central line average roughness) was 0.5 micron. After washing with water, the aluminium sheet was etched by soaking in a 10% aqueous sodium hydroxide heated at 70° C. till the quantity of dissolved aluminium became 6 g/m$^2$. After washing with water, the etched aluminium sheet was neutralized by dipping in a 30% aqueous solution of nitric acid for 1 minute, and washed thoroughly with water. Thereafter, the sheet surface was further roughened electrolytically in a 0.7% aqueous solution of nitric acid by passing therethough electric current for 20 seconds in the form of a rectangular alternating wave having an anodic voltage of 13 volt and a cathodic voltage of 6 volt (as described in JP-B-55-19191), cleaned by dipping in a 50° C. solution containing 20% sulfuric acid, and then washed with water. Further, the aluminium sheet was subjected to an anodic oxidation treatment in a 20% aqueous solution of sulfuric acid till the coverage of anodically oxidized coat became 3.0 g/m$^2$, washed with water and dried to prepare a base plate.

The thus processed base plate was coated with a solution having the following composition by means of a bar coater, and dried at 120° C. for 10 minutes. Thus, a printing plate precursor was produced.

Coating Composition for Photoconductive Layer

Hydrazone compound illustrated below — 25 parts

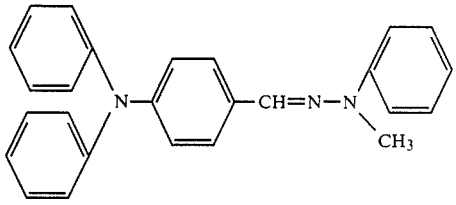

Benzylmethacrylate/methacrylic acid copolymer (methacrylic acid Fraction: 40 mol %) — 75 parts Thiapyrylium salt compound illustrate below — 1.18 parts

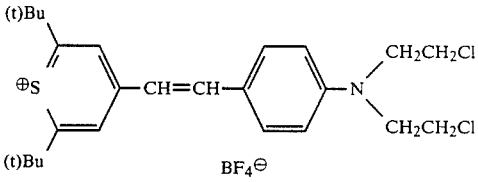

Methylene chloride — 510 parts

Methyl cellosolve acetate — 150 parts

The thus prepared printing plate precursor had a dry thickness of 4 microns.

Preparation of Liquid Developer

After the resin of Copolymer 4 in this invention was ground in fine particles with a size of several tens of microns with a sample mill, 1 part thereof was mixed with 10 parts of a 5 wt % solution of styrene/butadiene copolymer, Sorprene 1205 (St/Bu ratio: 25/75 by weight, products of Asahi Chemical Industry Co., Ltd.), in Isopar H (a hydrocarbon solvent of isoparaffin type, products of Exxon Co.), and then subjected to 20 minutes' predispersion with a paint shaker (made by Toyo Seiki Co., Ltd.) utilizing glass beads (diameter: 4–5 mm). Further, the wet dispersion with a Dyno mill (made by Shinmaru Enterprise Co., Ltd.) using glass beads (diameter: about 1 mm) as media was carried out for 2 hours.

A 20 g portion of the thus obtained dispersion was diluted with a lliter of an Isopar G solution containing $1\times10^{-6}$ mol of zirconium naphthenate to prepare a positively chargeable liquid developer (A).

Then, the printing plate precursor produced herein was charged with a corona charging device in the dark to gain the surface potential of +400 V, exposed to tungsten light, and subsequently subjected to reverse development with the liquid developer of this invention in the usual way (bias voltage: +350 V).

Thus, a clear white image was formed in the area corresponding to the exposed part, and the image was fixed by heating at 140° C. for 2 minutes.

The nonimage part was removed by soaking the plate precursor for 1 minute in an etching solution prepared by diluting a mixture of 40 parts of potassium silicate, 10 parts of potassium hydroxide, 10 parts of benzyl alcohol and 90 parts of ethanol with 800 parts of water, followed by thoroughly washing with water. As a result of the examination in an image quality of the thus obtained printing plate with a standard chart (Ugra-Offset-Test kail produced by Cohan Co., 1982), it turned out that 20-micron fine line nega-posi images and from 5% to 95% dot images (150 lines/inch) were reproduced in a satisfactory condition. In addition, a peel-part phenomenon of the toner image was not observed at all. Accordingly, the toner image proved to have sufficiently high resistance to the etching solution.

As a result of printing from this printing plate in the usual way, the plate was found to have a printing impression capable of producing 100,000 copies.

Further, the liquid developer of this invention was examined for the dispersion stability by undergoing a forced aging test at 50° C. Therein, agglutination of toner particles was not observed at all even after a one-week lapse. This aged developer was used for development of the printing plate precursor in the same manner as described above, producing the same result as the unaged, fresh developer. Also, any changes in etching characteristics and printing impression were not caused by using the aged developer.

Now, toner characteristics achieved are shown in Table 1.

TABLE 1

| | Before Forced Aging | | After Forced Aging (at 50° C. for a week) | |
|---|---|---|---|---|
| | Particle Size | Quantity of Charge | Particle Size | Quantity of Charge |
| Developer-A | 0.80μ | 23 mV | 0.82μ | 22 mV |

The quantity of charge was measured with the apparatus illustrated in JP-A-57-58176. The value cited above are expressed using toner particle density converted to a 1 g/1 basis. the particle size was measured with a nonasizer (made by Nikkaki Co.). Additionally, the forced aging test was undergone under the same condition (at 50° C. for one week) in other cases below.

EXAMPLE 2

A liquid developer (B) was prepared in the same manner as in Example 1, except the resin for the developer was replaced by the resin of Polymer 6 of this invention. The same tests as in Example 1 were undergone under the same conditions as in Example 1. Toner characteristics achieved are shown in Table 2.

TABLE 2

| | Before Forced Aging | | After Forced Aging | |
|---|---|---|---|---|
| | Particle Size | Quantity of Charge | Particle Size | Quantity of Charge |
| Developer-B | 0.55μ | 28 mV | 0.58μ | 25 mV |

The image formed on the original plate by etching reproduced 15 to 20-micron fine line nega-posi images and from 5% to 95% dot images in a satisfactory condition. Thus, it turned out that the liquid developer obtained was excellent in resist quality of the toner image and keeping stability.

EXAMPLE 3

A liquid developer was prepared using the resin of Copolymer 10 in this invention in a manner as described below.

Three parts of the resin of Polymer 10 and 1 part of carbon black #30 (produced by Mitsubishi Chemical Industries Ltd.) were mixed, and kneaded for 30 minutes with a two-rod roll mill under heating at 125° C. After cooling, the blend was roughly ground, and then finely ground with a pin mill. Then, one part of the finely ground matter and 10 parts of a 5 wt % Sorprene 1205 solution were subjected to 20 minutes' predispersion with a paint shaker utilizing glass beads (diameter: 4–5 mm) as media. Further, the regular dispersion with a Dyno mill (3,000 r.p.m.) using glass beads with a diameter of about 1 mm as media was carried out for 2 hours.

Then, a 20 g portion of the thus obtained dispersion was diluted with 1 liter of an Isopar G solution containing $1\times10^{-6}$ mol of zirconium naphthenate to prepare a positively chargeable liquid developer (C).

An original plate for printing was produced using the same printing plate precursor and the same etching solution as in Example 1, and performing development and etching in the same manners as in Example 1. The thus produced printing plate reproduced 20-micron fine line nega-posi images and from 5% to 95% dot images (150 lines/inch) in a satisfactory condition, which showed the excellency of the liquid developer using the resin of this invention in resist quality. Characteristics achieved by the toner of this invention are shown in Table 3.

TABLE 3

| | Before Forced Aging | | After Forced Aging | |
|---|---|---|---|---|
| | Particle Size | Quantity of Charge | Particle Size | Quantity of Charge |
| Developer-C | 0.50μ | 30 mV | 0.52μ | 28 mV |

EXAMPLE 4

A printing plate precursor was produced in the same manner as in Example 1, except said photoconductive layer was replaced by the following one:

(Dispersion for Photoconductive Layer)

Trisazo compound illustrated below 1.0 parts

-continued (Dispersion for Photoconductive Layer)

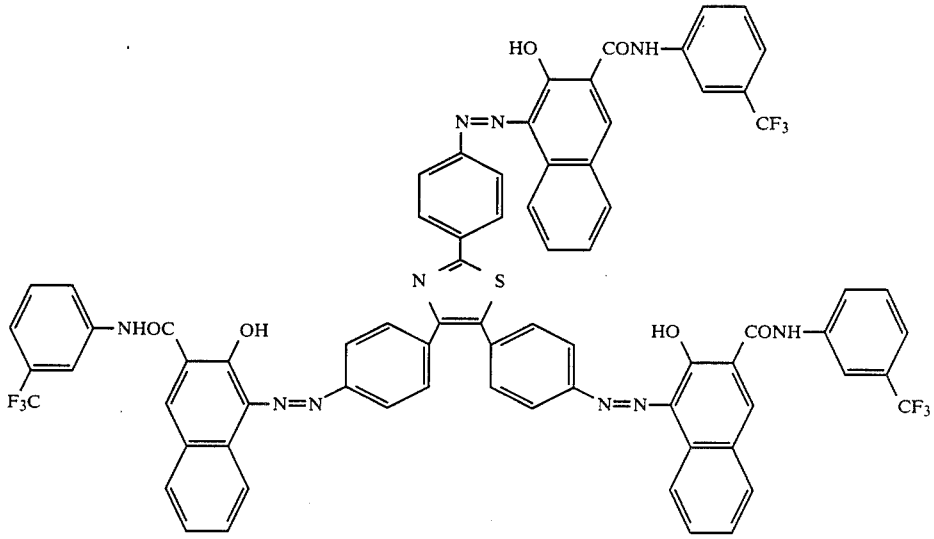

Oxazole compound illustrated below 2.5 parts

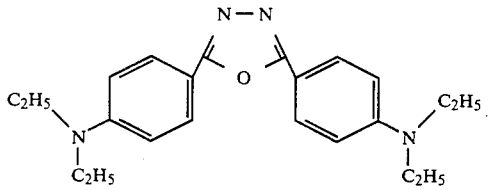

Vinyl acetate/crotonic acid copolymer 10 parts
(RESYN No. 28-1310, produced by Kanebo NSC Co., Ltd.)
Tetrahydrofuran 100 parts These ingredients were mixed, and then dispersed for 30 minutes with a Dyno mill (made by Sinmaru Enterprise Co., Ltd.) to prepare a dispersion for a photoconductive layer. This dispersion was coated and dried in the same manner as in Example 1 to produce a printing plate precursor. A thickness of the plate was 4 microns. The thus obtained plate underwent the same tests as in Example 1.

As a result of the tests, it turned out that this plate had characteristics similar to those achieved in Example 1.

EXAMPLE 5

The same tests as in Example 1 were made, except said etching solution was replaced by the following one:

| (Composition of Etching Solution) | |
|---|---|
| Potassium silicate | 40 parts |
| Phenethyl alcohol | 20 parts |
| Benzyl alcohol | 40 parts |
| Water | 900 parts |

As a result of the tests, it turned out that the original plate having the same image quality as in Example 1 was produced. According to the printing test, the plate showed a printing impression equivalent to that in Example 1. That is to say, the liquid developer (A) prepared in accordance with this invention proved to also have sufficiently high resistance to the etching solution used herein.

EXAMPLE 6

The liquid developer prepared in Example 3 was applied to the printing plate precursor obtained in Example 4, and the etching was carried out using the etching solution prepared in Example 1.

Thereby, in analogy with Example 1, an original plate excellent in fine line reproducibility was obtained. As for the result of the printing test, the plate showed the same printing impression as in Example 1.

EXAMPLE 7

The same tests were made in the same manner as in Example 6, except said etching solution was replaced by one which was used in Example 5. As a result thereof, an original plate excellent in fine line reproducibility was produced in analogy with Example 6.

COMPARATIVE EXAMPLE 1

Liquid developers were prepared using the resins of Comparative Copolymers 1 to 4 in the same manner as in Example 1, and development, fixation and etching were performed under the same conditions as in Example 1, respectively.

Therein, it turned out that every liquid developer was insufficient in resistance to the etching solution, so a part of toner image was decoated. Namely, the image reproducibility of each developer was markedly inferior to those attained in Examples 1 to 7.

EXAMPLES 8 AND 9

Liquid developers (D) and (E) were prepared in the same manner as in Example 1, except the resins of Copolymers 11 and 15 in this invention, respectively, were employed in place of the resin used for the liquid developer (A). The same tests as in Example 1 were made under the same conditions as in Example 1, respectively. The thus prepared toners had the characteristics shown in Table 4.

TABLE 4

| | Before Forced Aging | | After Forced Aging | |
|---|---|---|---|---|
| | Particle Size | Quantity of Charge | Particle Size | Quantity of Charge |
| Developer-D | 0.45μ | 23 mV | 0.47μ | 21 mV |
| Developer-E | 0.55μ | 10 mV | 0.58μ | 18 mV |

The images formed on the original plate by etching reproduced 15 to 20-micron fine line nega-posi images and from 5% to 95% dot images in a satisfactory condition. Thus, it turned out that the liquid developers obtained were excellent in resist quality of the toner image and keeping stability.

EXAMPLE 10

A liquid developer was prepared using the resin of copolymer 19 in this invention in a manner described below.

Three parts of the resin of Polymer 19 and 1 part of carbon black #30 (produced by Mitsubishi Chemical Industries Ltd.) were mixed, and kneaded for 30 minutes with a two-rod roll mill under heating at 125° C. After cooling, the blend was roughly ground, and then finely ground with a pin mill. Then, one part of the finely ground matter and 10 parts of a 5 wt % Sorprene 1205 solution were subjected to 20 minutes' predispersion with a paint shaker utilizing glass beads (diameter: 4–5 mm) as media. Further, the regular dispersion with a Dyno mill (3,000 r.p.m.) using glass beads with a diameter of about 1 mm as media was carried out for 2 hours.

Then, a 20 g portion of the thus obtained dispersion was diluted with 1 liter of an Isopar G solution containing $1\times10^{-6}$ mol of zirconium naphthenate to prepare a positively chargeable liquid developer (F).

An original plate for printing was produced using the same printing plate precursor and the same etching solution as in Example 8, and performing development and etching in the same manners as in Example 8. The thus produced printing plate reproduced 20 micron fine line nega-posi images and from 5% to 95% dot images (150 lines/inch) in a satisfactory condition, which showed the excellency of the liquid developer using the resin of this invention in resist quality. Characteristics achieved by the toner of this invention are shown in Table 5.

TABLE 5

| | Before Forced Aging | | After Forced Aging | |
|---|---|---|---|---|
| | Particle Size | Quantity of Charge | Particle Size | Quantity of Charge |
| Developer-F | 0.65μ | 15 mV | 0.68μ | 13 mV |

EXAMPLE 11

The same tests as in Example 8 were made under the same conditions as in Example 8, except the printing plate was replaced by one which was used in Example 4. Thus, the original plate having the same properties as acquired in Example 8 was obtained.

EXAMPLE 12

The same tests as in Example 8 were made, except said etching solution was replaced by the following ones;

| Composition of Etching Solution: | | |
|---|---|---|
| (1) | Potassium silicate | 40 parts |
| | Phenethyl alcohol | 20 parts |
| | Benzyl alcohol | 40 parts |
| | Water | 900 parts |
| (2) | DP-4 | 1 part |
| | Ethanol | 1 part |
| | Water | 7 parts |

As a result of the tests, it turned out that the original plates having the same image quality as in Example 8 were produced. According to the printing test, the plates showed a printing impression equivalent to that in Example 8. That is to say, the liquid developer (D) prepared in accordance with this invention proved to also have sufficiently high resistance to the etching solutions used herein.

EXAMPLE 13

The liquid developer prepared in Example 10 was applied to the printing plate precursor obtained in Example 11, and the etching was carried out using the etching solution prepared in Example 8.

Thereby, in analogy with Example 8, an original plate excellent in fine line reproducibility was obtained. As for the result of the printing test, the plate showed the same printing impression as in Example 8.

EXAMPLE 14

The same tests were made in the same manner as in Example 13, except said etching solution was replaced by ones which were used in Example 12. As a result thereof, original plates excellent in fine line reproducibility were produced in analogy with Example 13.

COMPARATIVE EXAMPLE 2

Liquid developers were prepared using the resins of Comparative Copolymers 5 to 8 in the same manner as in Example 8. Development, fixation and etching were performed under the same conditions as in Example 8, respectively, to produce original plates.

Therein, every liquid developer was insufficient in resistance to the etching solution, so a part of toner image was decoated.

As clearly seen from the results of the examples, the copolymer resins of this invention had sufficient resistance to etching solutions and imparted desirable basic characteristics to a liquid developer when employed as image forming particles of the liquid developer to be applied to decoating type printing plate.

While the invention has been described in detail and with reference to specific embodiments thereof, it will be apparent to one skilled in the art that various changes and modifications can be made therein without departing from the spirit and scope thereof.

What is claimed is:

1. A positively chargeable liquid developer to be used in making a printing plate by developing an electrostatic image formed on the surface of a printing plate precursor with a liquid developer and then by decoating the non-image area, said plate comprising a conductive base plate having provided thereon an electrophotographic photoreceptive layer, said liquid developer containing image forming particles comprising a resin which is prepared by copolymerizing monomers of formulae (I), (II) and (III) in a copolymerizing ratio of 0.1–9.9:-90–99.8:0.1–10 by weight percent, said resin having a number average molecular weight ranging from $5\times10^3$ to $5\times10^5$ and a softening point ranging from 40° C. to 150° C.:

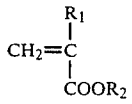
(I)

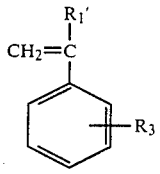
(II)

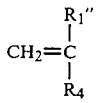
(III)

wherein $R_1$, $R_1'$ and $R_1''$ each represents a hydrogen atom or a methyl group; $R_2$ represents an straight-chain or branched alkyl group containing 4 to 22 carbon atoms; $R_3$ represents a hydrogen atom, or a straight-chain or branched alkyl group containing 1 to 4 carbon atoms; $R_4$ represents

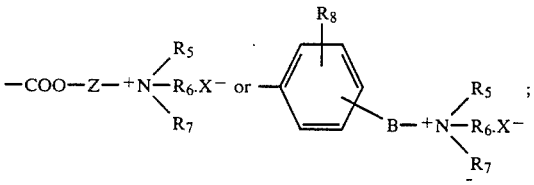

Z and B each represents $-(CH_2)_n-$ (n=1–4), but B may be absent from the group represented by $R_4$; $X^-$ represents an anion: $R_5$, $R_6$ and $R_7$ may be the same or different, each being a straight-chain or branched alkyl group containing 1 to 12 carbon atoms, or a hydrogen atom, and $R_8$ has the same definition as $R_3$.

2. A positively chargeable liquid developer as in claim 1, wherein $R_2$ represents a straight-chain or branched alkyl group comprising 8 to 22 carbon atoms.

3. A positively chargeable liquid developer as in claim 1, wherein at least one of $R_3$ and $R_8$ are selected from the group consisting of a hydrogen atom and a methyl group.

4. A positively chargeable liquid developer as in claim 1, wherein said image-forming particles further comprise a coloring agent.

5. A positively chargeable liquid developer to be used in making a printing plate by developing an electrostatic image formed on the surface of a printing plate precursor with a liquid developer and then by decoating the non-image area, said plate comprising a conductive base plate having provided thereon an electrophotographic photoreceptive layer, said liquid developer containing image-forming particles comprising a resin which is prepared by copolymerizing monomers of formulae (A),(I),(II) and (III) in a copolymerizing ratio of 5–50-:1–25:48–93:0.1–10 by weight percent, said resin having a number average molecular weight ranging from $5\times10^3$ to $5\times10^5$ and a softening point ranging from 40° C. to 150° C.:

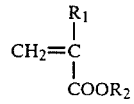
(I)

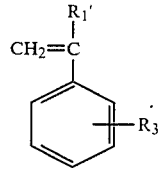
(II)

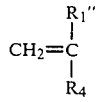
(III)

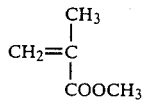
(A)

wherein $R_1$, $R_1'$, and $R_1''$ each represents a hydrogen atom or a methyl group; $R_2$ represents a straight-chain or branched alkyl group containing 4 to 22 carbon atoms; $R_3$ represents a hydrogen atom or a straight-chain or branched alkyl group containing 1 to 4 carbon atoms; $R_4$ represents

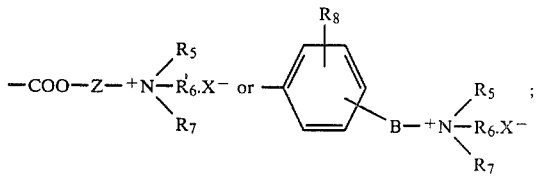

Z and B each represents $-(CH_2)_n-$ (n=1–4), but B may be absent from the group represented by $R_4$; $X^-$ represents an anion; $R_5$, $R_6$ and $R_7$ may be the same or different, each being a straight-chain or branched alkyl group containing to 12 carbon atoms, or a hydrogen atom, and $R_8$ has the same definition as $R_3$.

6. A positively chargeable liquid developer as in claim 5, wherein $R_2$ represents a straight-clain or branched alkyl group comprising 8 to 22 carbon atoms.

7. A positively chargeable liquid developer as in claim 5, wherein at least one of $R_3$ and $R_8$ are selected from the group consisting of a hydrogen atom and a methyl group.

8. A positivety chargeable liquid developer as in claim 5, wherein said image-forming particles further comprise a coloring agent.

9. A process for forming a printing plate, comprising forming an electrostatic image formed on the surface of a printing plate precursor comprising a conductive base plate having provided thereon an electrophotographic photoreceptive layer, developing said electrostatic image with a positively chargeable liquid developer and then decoating the non-image area with an alkaline etching solution, said liquid developer containing image-forming particles comprising a resin which is prepared by copolymerizing monomers of formulae (I), (II) and (III) in a copolymerizing ratio of 0.1–9.9: 90–99.8:0.01–10 by weight percent, said resin having a number average molecular weight ranging from $5\times10^3$ to $5\times10^5$ and a softening point ranging from 40° C. to 150° C.:

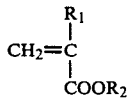
(I)

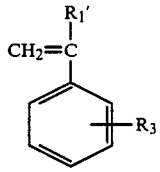
(II)

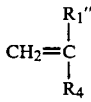
(III)

wherein $R_1$, $R_1'$ and $R_1''$ each represents a hydrogen atom or a methyl group; $R_2$ represents a straight-chain or branched alkyl group containing 4 to 22 carbon atoms; $R_3$ represents a hydrogen atom or a straight-chain or branched alkyl group containing 1 to 4 carbon atoms; $R_4$ represents

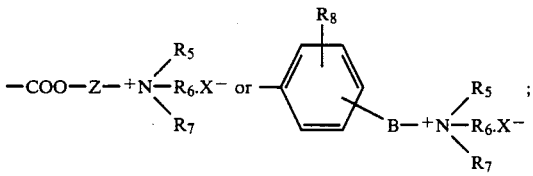

Z and B each represents $-(CH_2)_n-$ (n=1–4), but B may be absent from the group represented by $R_4$; $X^-$ represents an anion; $R_5$, $R_6$ and $R_7$ may be the same or different, each being a straight-chain or branched alkyl group containing 1 to 12 carbon atoms, or a hydrogen atom, and $R_8$ has the same definition as $R_3$.

10. A process for forming a printing plate as in claim 9, wherein $R_2$ represents a straight-chain or branched alkyl group comprising 8 to 22 carbon atoms.

11. A process for forming a printing plate as in claim 9, wherein at least one of $R_3$ and $R_8$ are selected from the group consisting of a hydrogen atom and a methyl group.

12. A process for forming a printing plate as in claim 9, wherein said image-forming particles further comprise a coloring agent.

13. A process for forming a printing plate, comprising forming an electrostatic image formed on the surface of a printing plate precursor comprising a conductive base plate having provided thereon an electrophotographic photoreceptive layer, developing said electrostatic image with a positively chargeable liquid developer and then by decoating the non-image area with an alkaline etching solution, said liquid developer containing image-forming particles comprising a resin which is prepared by copolymerizing monomers of formulae (A), (I), (II) and (III) in a copolymerizing ratio of 5–50-:1–25:48–93:0.1–10 by weight percent, said resin having a number average molecular weight ranging from $5\times10^3$ to $5\times10^5$ and a softening point ranging from 40° C. to 150° C.:

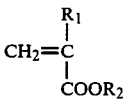
(I)

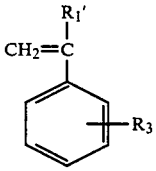
(II)

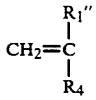
(III)

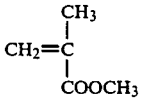
(A)

wherein $R_1$, $R_1'$, and $R_1''$ each represents a hydrogen atom or a methyl group; $R_2$ represents a straight-chain or branched alkyl group containing 4 to 22 carbon atoms, $R_3$ represents a hydrogen atoms or a straight-clain or branched alkyl group containing 1 to 4 carbon atoms; $R_4$ represents

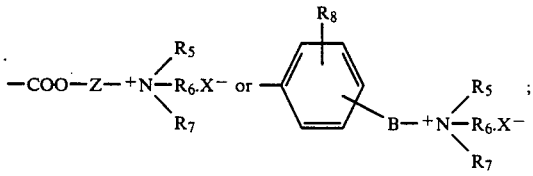

Z and B each represents $-(CH_2)_n-$ (n=4–4), but B may be absent from the group represented by $R_4$; $X^{31}$ represents an anion; $R_5$, $R_6$ and $R_7$ may be the same or different, each being a straight-chain or branched alkyl group containing 1 to 12 carbon atoms, or a hydrogen atom, and $R_8$ has the same definition as $R_3$.

14. A process for forming a printing plate as in claim 13, wherein $R_2$ represents a straight-chain or branched alkyl group comprising 8 to 22 carbon atoms.

15. A process for forming a printing plate as in claim 13, wherein at least one of $R_3$ and $R_8$ are selected from the group consisting of a hydrogen atom and a methyl group.

16. A process for forming a printing plate as in claim 13, wherein said image-forming particles further comprise a coloring agent.

* * * * *